US007918545B2

(12) United States Patent
Kim et al.

(10) Patent No.: US 7,918,545 B2
(45) Date of Patent: Apr. 5, 2011

(54) INK-JET HEAD

(75) Inventors: Boum-Seock Kim, Suwon-si (KR); Jae-Woo Joung, Suwon-si (KR); Ju-Hwan Yang, Suwon-si (KR); Young-Seuck Yoo, Seoul (KR)

(73) Assignee: Samsung Electro Mechanics Co., Ltd., Gyunggi-do (KR)

( * ) Notice: Subject to any disclaimer, the term of this patent is extended or adjusted under 35 U.S.C. 154(b) by 103 days.

(21) Appl. No.: 12/503,492

(22) Filed: Jul. 15, 2009

(65) Prior Publication Data

US 2010/0182381 A1 Jul. 22, 2010

(30) Foreign Application Priority Data

Jan. 21, 2009 (KR) ..... 10-2009-0005122

(51) Int. Cl.
*B41J 2/045* (2006.01)

(52) U.S. Cl. ..... 347/68

(58) Field of Classification Search ..... 347/70
See application file for complete search history.

(56) References Cited

FOREIGN PATENT DOCUMENTS

JP 2003-136735 5/2003

OTHER PUBLICATIONS

Korean Office Action issued in Korean Patent Application No. KR 10-2009-0005122 dated Jan. 3, 2011.

*Primary Examiner* — Matthew Luu
*Assistant Examiner* — Lisa M Solomon
(74) *Attorney, Agent, or Firm* — McDermott Will & Emery LLP

(57) ABSTRACT

An ink-jet head is disclosed. The ink-jet head can include: a channel for holding ink, a nozzle connected with the channel, a pressurizing unit configured to apply pressure to the ink so as to eject the ink, a partition coupled to one side of the channel so as to block the channel, and an actuator configured to deform one side of the channel so as to open the channel. While pressure is applied to the ink, this pressure can be turned on and off, to provide pressure pulses for ejecting the ink. As such, with this arrangement, the ejection properties of the ink-jet head can be adjusted to various settings.

6 Claims, 2 Drawing Sheets

INK-JET HEAD

CROSS-REFERENCE TO RELATED APPLICATIONS

This application claims the benefit of Korean Patent Application No. 10-2009-0005122, filed with the Korean Intellectual Property Office on Jan. 21, 2009, the disclosure of which is incorporated herein by reference in its entirety.

BACKGROUND

1. Technical Field

The present invention relates to an ink-jet head.

2. Description of the Related Art

The application of ink-jet technology has expanded beyond the field of the graphics industry, for making prints on paper and fabric, etc., to the field of manufacturing, for example, printed circuit boards and electronic parts, such as LCD panels, etc. Accordingly, the ink-jet head is required to provide higher performance in modern applications.

An ink-jet head is a device that performs a printing operation by converting an electrical signal into a physical force to eject ink droplets through a number of nozzles. An ink-jet head can be composed of a chamber for holding the ink, a piezoelectric component coupled to one side of the chamber to directly apply pressure to the chamber, and a nozzle coupled to the other side of the chamber.

When voltage is applied to the piezoelectric component, the deformation of the piezoelectric component can apply pressure to the chamber, so that ink may be ejected through the nozzle. As the pressure generated by the piezoelectric component may be used directly in ejecting the ink, the piezoelectric properties of the piezoelectric component are a major factor in determining the ejection properties of the ink-jet head.

However, the ejection properties required of current ink-jet heads may be difficult to achieve using a piezoelectric component that directly applies pressure to the chamber. An ink-jet head based on this type of structure may thus be limited in providing improved performance.

SUMMARY

An aspect of the invention is to provide an ink-jet head capable of implementing various ejection property settings.

Another aspect of the invention provides an ink-jet head that includes: a channel for holding ink, a nozzle connected with the channel, a pressurizing unit configured to apply pressure to the ink so as to eject the ink, a partition coupled to one side of the channel so as to block the channel, and an actuator configured to deform one side of the channel so as to open the channel.

The ink-jet head can further include a reservoir configured to supply the ink to the channel, and the pressurizing unit can be configured to apply pressure inside the reservoir.

One side of the channel can be made from a membrane, where the partition can be coupled to the membrane. The actuator can also be coupled to the membrane. The actuator can be configured to curve the membrane such that the partition is separated from the other side of the channel.

The actuator can include a piezoelectric component.

Additional aspects and advantages of the present invention will be set forth in part in the description which follows, and in part will be obvious from the description, or may be learned by practice of the invention.

DETAILED DESCRIPTION

Figure 1:
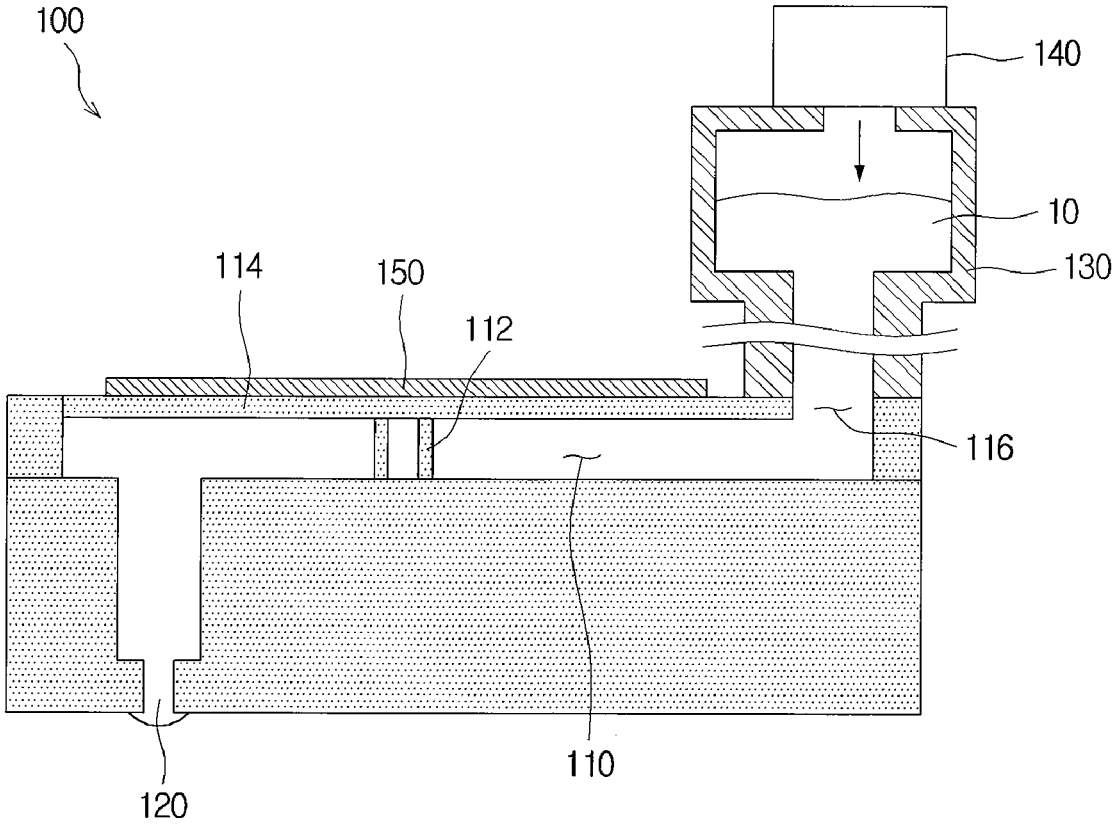
FIG. 1 is a cross-sectional view of an ink-jet head according to an embodiment of the invention.

The ink-jet head according to certain embodiments of the invention will be described below in more detail with reference to the accompanying drawings. Those elements that are the same or are in correspondence are rendered the same reference numeral regardless of the figure number, and redundant descriptions are omitted.

FIG. 1 is a cross-sectional view of an ink-jet head 100 according to an embodiment of the invention. As in the example shown in FIG. 1, an ink-jet head 100 according to an embodiment of the invention can include a channel 110 in which ink 10 is held, a nozzle 120 connected with the channel 110, a pressurizing unit 140 that applies pressure to the ink 10 so that the ink 10 may be ejected, a partition 112 coupled to one side of the channel 110 to block the channel 110, and an actuator 150 that deforms one side of the channel 110 to open the channel 110. While pressure is applied to the ink 10, this pressure can be turned on and off to provide pressure pulses for ejecting the ink 10. As such, with this arrangement, the ejection properties of the ink-jet head 100 can be adjusted to various settings.

The channel 110 can include a space for holding the ink 10 inside and can be structurally positioned between the nozzle 120 and a reservoir 130.

The nozzle 120 can be formed at one end of the channel 110, while an inlet 116 connected with the reservoir 130 can be formed at the other end of the channel 110. The ink 10 held in the channel 110 may be ejected out of the ink-jet head 100 by way of the nozzle 120. The reservoir 130 can be a tank storing the ink 10. The reservoir 130 can store the ink 10 inside, and can supply the ink 10 to the channel 110 through the inlet 116.

The pressurizing unit 140 can be coupled to the reservoir 130. The pressurizing unit 140 may pressurize the inside of the reservoir 130, to apply pressure to the ink 10 held in the channel 110. Thus, the pressurizing unit 140 may keep the ink 10 in the channel 110 in a pressurized state, which can force the ink 10 to be ejected through the nozzle 120. The composition of the pressurizing unit 140 may include a pneumatic pump, etc.

One side of the channel 110 can include a membrane 114, which can be made from a thin silicon substrate material. The channel 110 can be deformed by the operation of the actuator 150, which will be described later in more detail, so that the cross-section of the channel 110 may be changed.

A partition 112 can be coupled to one side of the channel 110. The partition 112 can be coupled onto the inner wall on the channel 110 side of the membrane 114. The shape of the partition 112 can be substantially the same as the cross-section of the channel 110, so that the partition 112 may block the channel 110.

Thus, when the actuator 150 is not operated, the partition 112 can block the inside of the channel 110 and thus stop the flow of ink 10. To improve the blocking effect in the channel 110, a multiple number of partitions 112 can be coupled to the membrane 114 along the flow direction of ink 10.

The actuator 150 can deform one side of the channel 110 such that the channel 110 is opened. The actuator 150 can include, for example, a piezoelectric component, which can be coupled onto the membrane 114.

Figure 2:
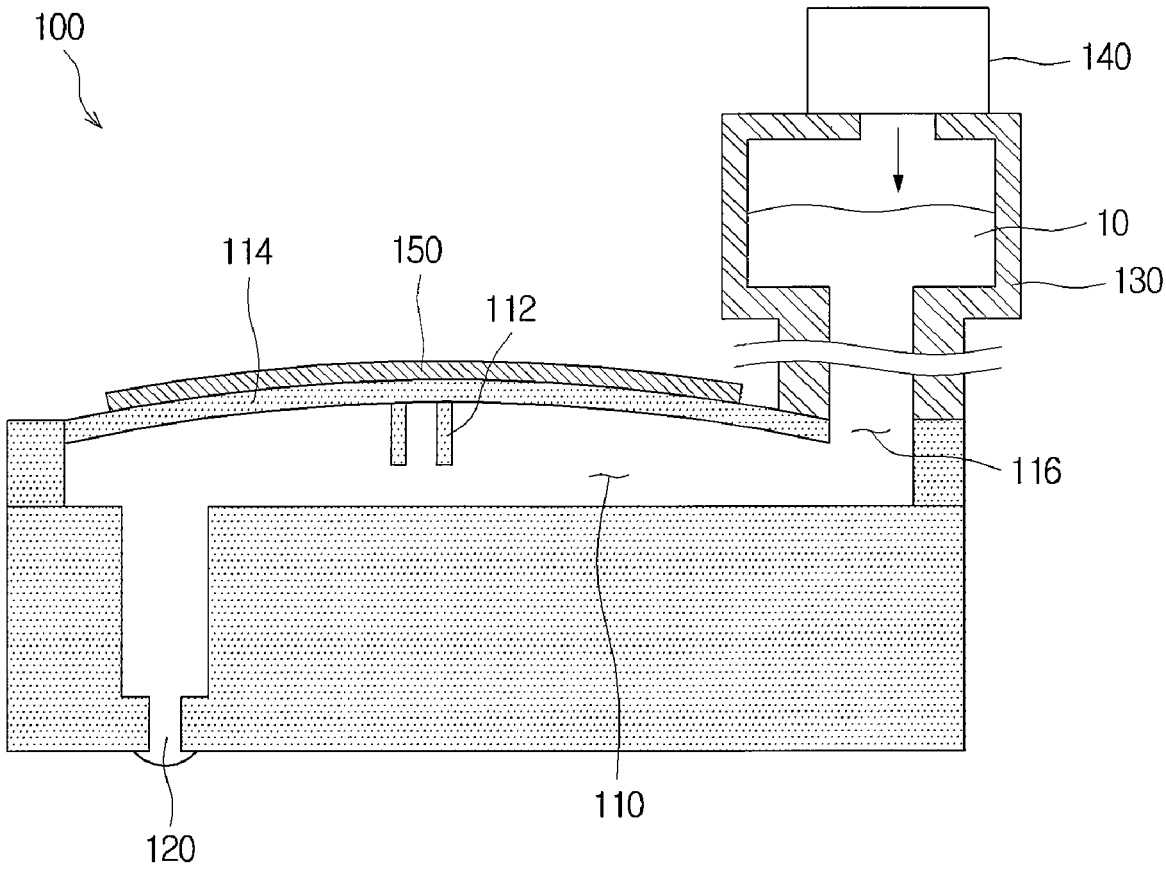
FIG. 2 is a cross-sectional view illustrating an action of an ink-jet head according to an embodiment of the invention.

FIG. 2 is a cross-sectional view illustrating an action of an ink-jet head 100 according to an embodiment of the invention. As in the example shown in FIG. 2, when a voltage is applied to the actuator 150, the piezoelectric component may be deformed according to its direction of polarization. In this particular example, the deformation may occur about the center portion of the piezoelectric component, curving the membrane 114 such that the partition 112 is separated from the other side of the channel 110.

When the partition 112 is separated from the bottom surface of the channel 110, the ink 10 pressurized by the pressurizing unit 140 may move towards the nozzle 120 and may eventually be ejected through the nozzle 120. Here, the actuator 150 including the piezoelectric component can turn the flow of the ink 10 within the channel 110 on or off to control the ejection of the ink-jet head 100.

The role of the actuator 150 differs from the role of the conventional piezoelectric component of supplying the pressure for ejecting the ink 10, as the actuator 150 is used in turning on or off the flow of the ink 10. As such, the actuator 150 can be implemented with a smaller piezoelectric component. Also, the operation of ejecting the ink 10 can be implemented using a lower operating voltage, so that the operating voltage of the actuator 150 may be reduced.

Furthermore, by adjusting the pressure applied to the ink 10 by the pressurizing unit 140, the ejection speed, etc., of the ink 10 may also be controlled. Therefore, the ejection properties, including the ejection speed and ink droplet size, for example, can be adjusted to various settings, by controlling the operation of the actuator 150 and the pressurizing unit 140.

While the spirit of the invention has been described in detail with reference to particular embodiments, the embodiments are for illustrative purposes only and do not limit the invention. It is to be appreciated that those skilled in the art can change or modify the embodiments without departing from the scope and spirit of the invention.

What is claimed is:

1. An ink-jet head comprising:

a channel for holding ink;

a nozzle connected with the channel;

a pressurizing unit configured to apply pressure to the ink so as to eject the ink;

a partition coupled to one side of the channel so as to block the channel; and an actuator configured to deform one side of the channel so as to open the channel.

2. The ink-jet head of claim 1, further comprising a reservoir configured to supply the ink to the channel, wherein the pressurizing unit is configured to apply pressure inside the reservoir.

3. The inkjet head of claim 1, wherein:

the one side of the channel comprises a membrane; and the partition is coupled to the membrane.

4. The ink-jet head of claim 3, wherein the actuator is coupled to the membrane.

5. The ink-jet head of claim 4, wherein the actuator is configured to curve the membrane such that the partition is separated from the other side of the channel.

6. The ink-jet head of claim 1, wherein the actuator comprises a piezoelectric component.

* * * * *